US011326456B2

(12) United States Patent
Ikeuchi

(10) Patent No.: US 11,326,456 B2
(45) Date of Patent: May 10, 2022

(54) VIBRATION SUPPRESSION DEVICE FOR ROTARY MACHINE AND ROTARY MACHINE

(71) Applicant: MITSUBISHI HEAVY INDUSTRIES, LTD., Tokyo (JP)

(72) Inventor: Nanoha Ikeuchi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/091,133

(22) Filed: Nov. 6, 2020

(65) Prior Publication Data

US 2021/0148234 A1 May 20, 2021

(30) Foreign Application Priority Data

Nov. 18, 2019 (JP) ..... JP2019-208176

(51) Int. Cl.
*F01D 5/16* (2006.01)

(52) U.S. Cl.
CPC ..... *F01D 5/16* (2013.01); *F05D 2220/32* (2013.01); *F05D 2240/30* (2013.01); *F05D 2260/96* (2013.01)

(58) Field of Classification Search
CPC ..... F01D 5/10; F01D 5/14; F01D 5/16; F01D 5/22; F01D 5/24; F01D 5/26; F01D 5/30; F01D 25/04; F01D 25/06; F05D 2220/32; F05D 2240/30; F05D 2260/96; F04D 29/66; F04D 29/661; F04D 29/666; F04D 29/668
See application file for complete search history.

(56) References Cited

U.S. PATENT DOCUMENTS 7,534,090 B2 * 5/2009 Good ..... F01D 5/26 416/193 A
2013/0195611 A1 * 8/2013 Retze ..... F01D 5/26 415/1
2019/0292923 A1 * 9/2019 MacMahon ..... F01D 25/06

FOREIGN PATENT DOCUMENTS

JP 2015-155683 8/2015
JP 2015-175356 10/2015

* cited by examiner

*Primary Examiner* — Woody A Lee, Jr.
*Assistant Examiner* — Elton K Wong
(74) *Attorney, Agent, or Firm* — Wenderoth, Lind & Ponack, L.L.P.

(57) ABSTRACT

A vibration suppression device for a rotary machine according to at least one embodiment of the present disclosure is a vibration suppression device for a rotor of a rotary machine including a damper pin movably provided inside a gap of the rotor, the damper pin including a magnet, and a magnetic force generation portion provided in the rotor at a periphery of the gap. The magnetic force generation portion is configured to exert, against the magnet, a magnetic force in a direction pushing the damper pin away from a stick region of the damper pin located on a radially outward side of the rotor in the gap.

9 Claims, 10 Drawing Sheets

VIBRATION SUPPRESSION DEVICE FOR ROTARY MACHINE AND ROTARY MACHINE

CROSS-REFERENCE TO RELATED APPLICATIONS

This application claims the benefit of priority to Japanese Patent Application Number 2019-208176 filed on Nov. 18, 2019. The entire contents of the above-identified application are hereby incorporated by reference.

TECHNICAL FIELD

The disclosure relates to a vibration suppression device for a rotary machine and a rotary machine.

RELATED ART

For example, a rotary machine such as a gas turbine or a steam turbine is provided with a rotor that includes rotor blades. The vibration of the rotor blades may result in fatigue failure. Thus, damping the vibration of rotor blades when they vibrate is desirable. Friction dampers are a known technology for damping the vibration of rotor blades. A friction damper utilizes the friction of a member to damp the vibration of the rotor blades. An example of a known friction damper includes a damper pin that is provided in the gaps between platform portions of rotor blades adjacent to one another in the circumferential direction, the damper pin extending in the rotation axis direction. With this friction damper, the frictional force generated at the contact surface between the platform portion and the damper pin damps the vibration of the rotor blades (see, for example, JP 2015-175356 A).

SUMMARY

However, with the friction damper described in JP 2015-175356 A, when the force (centrifugal force) exerted on the damper pin pushing it outward in the radial direction increases, the frictional force generated at the contact surface between the platform portion and the damper pin is excessive. This may put the damper pin in a stick state and cause the damper pin to not slip at the contact surface. When the damper pin is in such a stick state, the vibration damping effect on the rotor blades due to the frictional force decreases.

In light of the foregoing, at least one embodiment of the present disclosure has an object of minimizing or preventing a decrease in the vibration damping effect of a vibration suppression device for a rotary machine.

(1) A vibration suppression device for a rotary machine according to at least one embodiment of the present disclosure is a vibration suppression device for a rotor of a rotary machine, including a damper pin movably provided inside a gap of the rotor, the damper pin including a magnet, and a magnetic force generation portion provided in the rotor at a periphery of the gap. The magnetic force generation portion is configured to exert, against the magnet, a magnetic force in a direction pushing the damper pin away from a stick region of the damper pin located on a radially outward side of the rotor in the gap.

(2) A rotary machine according to at least one embodiment of the present disclosure includes a rotor, and a vibration suppression device for a rotary machine with the configuration of (1) described above.

According to at least one embodiment of the present disclosure, a decrease in the vibration damping effect of a vibration suppression device for a rotary machine can be minimized or prevented.

BRIEF DESCRIPTION OF DRAWINGS

The disclosure will be described with reference to the accompanying drawings, wherein like numbers reference like elements.

DESCRIPTION OF EMBODIMENTS

Embodiments of the present disclosure will be described hereinafter with reference to the appended drawings. It is intended, however, that unless particularly specified, dimensions, materials, shapes, relative positions and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Overall Configuration of Gas Turbine 1

Figure 1:
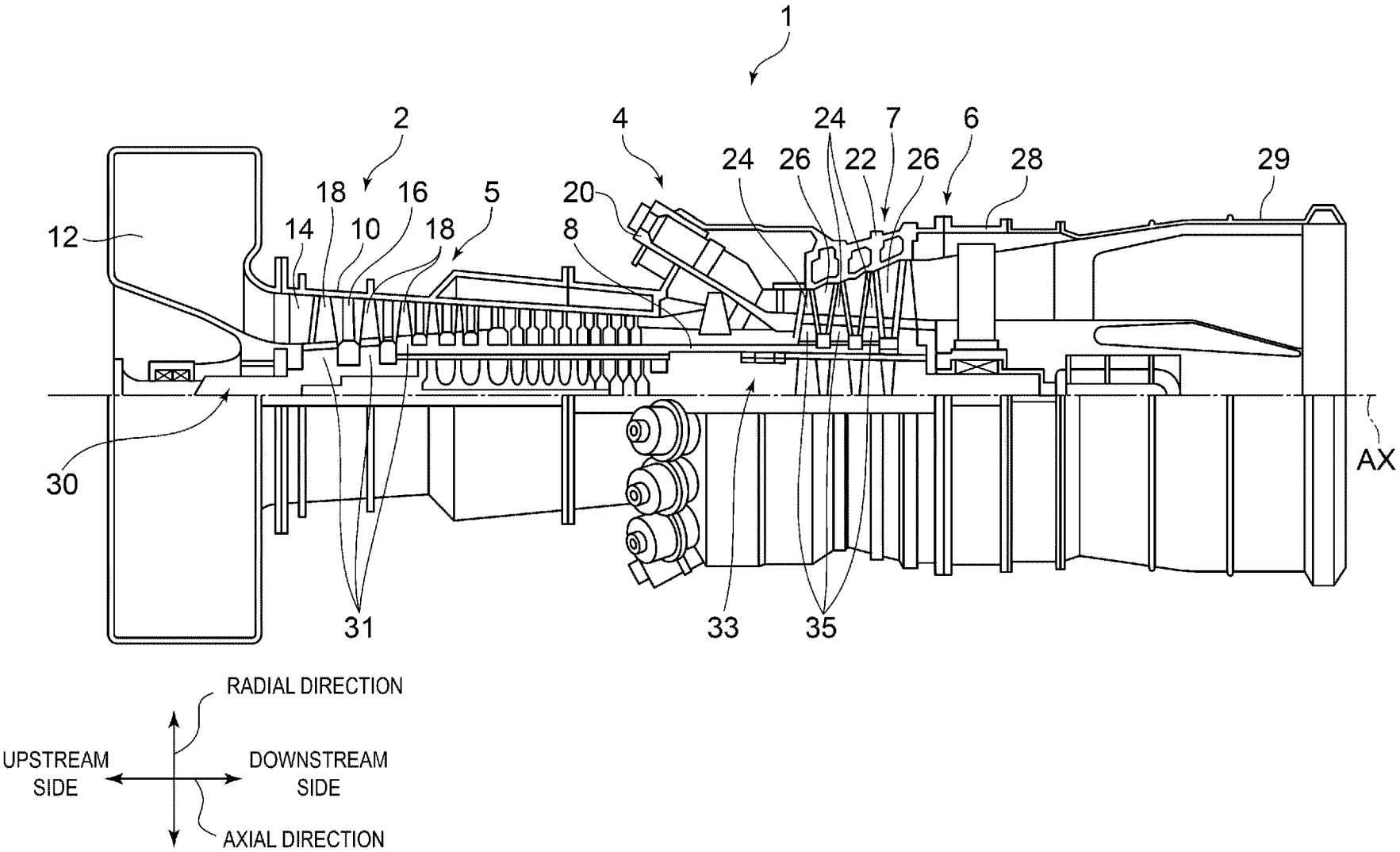
FIG. 1 is a schematic configuration diagram of a gas turbine.

First, the configuration of a rotary machine using a vibration suppression device for a rotary machine according to some embodiments will be described with reference to FIG. 1. FIG. 1 is a schematic configuration diagram of a gas turbine 1, which is an example of a device provided with the rotary machine. Note that the rotary machine using a vibration suppression device for a rotary machine according to some embodiments may be a compressor or may be a turbine.

As illustrated in FIG. 1, the gas turbine 1 according to an embodiment is provided with a compressor 2 for generating compressed air, a combustor 4 for generating combustion gas using the compressed air and fuel, and a turbine 6 configured to be rotationally driven by the combustion gas. In the case of the gas turbine 1 being for power generation, a non-illustrated power generator is connected to the turbine 6 and power is generated by the rotational energy of the turbine 6.

In the gas turbine 1 illustrated in FIG. 1, the compressor 2 is provided with a rotor 30 capable of rotating about a center axis AX and a stator 5 disposed at the periphery of the rotor 30. Note that in the gas turbine 1 illustrated in FIG. 1, the compressor 2 is provided with a vibration suppression device 100 for a rotary machine described below.

The stator 5 includes a compressor casing (casing) 10 and a plurality of compressor vanes 16 fixed to the compressor casing 10 side.

The rotor 30 includes a rotor shaft 8 capable of rotating about the center axis AX, a plurality of rotor discs 31 fixed to the rotor shaft 8, and a plurality of compressor blades 18 attached to each one of the plurality of rotor discs 31.

The rotor shaft 8 is provided extending through both the compressor casing 10 and a turbine casing 22 described below.

A plurality of the compressor blades 18 are disposed on the outer circumferential portion of each one of the plurality of rotor discs 31 in the circumferential direction of the center axis AX. In addition, the rotor discs 31 are disposed in a plurality stages at intervals in the direction parallel with the center axis AX. Accordingly, the compressor blades 18 are disposed in a plurality stages at intervals in the direction parallel with the center axis AX.

The plurality of compressor vanes 16 are disposed in the circumferential direction of the center axis AX. In addition, the compressor vanes 16 are disposed in a plurality stages at intervals in the direction parallel with the center axis AX. The compressor vanes 16 are disposed in a plurality stages between the compressor blades 18 in the direction parallel with the center axis AX.

Furthermore, in the gas turbine 1 illustrated in FIG. 1, the compressor 2 is provided with an air inlet port 12 provided on the inlet side of the compressor casing 10 for intaking air and an inlet guide vane 14 provided on the air inlet port 12 side. Note that the compressor 2 may be provided with other components such as an air bleed chamber (not illustrated). In this type of compressor 2, the air taken in from the air inlet port 12 passes through the plurality of compressor vanes 16 and the plurality of compressor blades 18 and compressed. This generates compressed air. The compressed air is then sent from the compressor 2 to the combustor 4 downstream.

In the gas turbine 1 illustrated in FIG. 1, the combustor 4 is disposed inside a casing (combustor casing) 20. As illustrated in FIG. 1, a plurality of the combustors 4 may be disposed in the casing 20 in an annular manner with the rotor shaft 8 as the center. Fuel and the compressed air generated at the compressor 2 is supplied to the combustor 4 and the fuel is combusted, and a high-temperature, high-pressure combustion gas, which is the working fluid of the turbine 6, is generated. Then, the combustion gas is sent from the combustor 4 to the turbine 6 downstream.

In the gas turbine 1 illustrated in FIG. 1, the turbine 6 is provided with a rotor 33 capable of rotating about the center axis AX and a stator 7 disposed at the periphery of the rotor 33.

The stator 7 includes a turbine casing (casing) 22 and a plurality of turbine vanes 26 fixed to the turbine casing 22 side.

The rotor 33 includes the rotor shaft 8 described above, a plurality of rotor discs 35 fixed to the rotor shaft 8, and a plurality of turbine blades 24 attached to each one of the plurality of rotor discs 35.

A plurality of the turbine blades 24 are disposed on the outer circumferential portion of each one of the plurality of rotor discs 35 in the circumferential direction of the center axis AX. In addition, the rotor discs 35 are disposed in a plurality stages at intervals in the direction parallel with the center axis AX. Accordingly, the turbine blades 24 are disposed in a plurality stages at intervals in the direction parallel with the center axis AX.

The plurality of turbine vanes 26 are disposed in the circumferential direction of the center axis AX. In addition, the turbine vanes 26 are disposed in a plurality stages at intervals in the direction parallel with the center axis AX. The turbine vanes 26 are disposed in a plurality stages between the turbine blades 24 in the direction parallel with the center axis AX.

Note that in the turbine 6, the rotor shaft 8 extends in the axial direction (the left-and-right direction in FIG. 1), and the combustion gas flows from the combustor 4 side toward an exhaust casing 28 side (from the left side to the right side in FIG. 1). Thus, in FIG. 1, the illustrated left side is the upstream side in the axial direction and the illustrated right side is the downstream side in the axial direction. Furthermore, in the following description, "axial direction" is used to simply refer to the direction parallel with the center axis AX, and "radial direction" is used to simply refer to the radial direction centered at the center axis AX. In the following description, "circumferential direction of the rotor" or simply "circumferential direction" refers to the circumferential direction centered at the center axis AX.

The turbine blades 24 and the turbine vanes 26 are configured to generate rotational driving force from the high-temperature, high-pressure combustion gas that flows inside the turbine casing 22. This rotational driving force is transmitted to the rotor shaft 8 to drive a non-illustrated power generator connected to the rotor shaft 8.

An exhaust chamber 29 is connected to the turbine casing 22 on the downstream side in the axial direction by interposing the exhaust casing 28. The combustion gas after driving the turbine 6 is discharged to the outside through the exhaust casing 28 and the exhaust chamber 29.

Vibration Suppression Device 100

The vibration suppression device 100 for a rotary machine according to some embodiments is attached to the compressor blades 18, for example. Note that the vibration suppression device 100 for a rotary machine according to some embodiments may be attached to the turbine blades 24, for example. In the example described below, the vibration suppression device 100 for a rotary machine according to some embodiments is attached to the compressor blades 18. In addition, in the following description, the compressor blades 18 are also simply referred to as rotor blades 18.

In some embodiments, as described below, the vibration suppression device 100 is movably provided inside a gap 130 of the rotor 30 and is provided with a damper pin 40 that includes a magnet 41 and a magnetic force generation portion 150 provided in the rotor 30 at the periphery of the gap 130.

Rotor Blade 18

Figure 2:
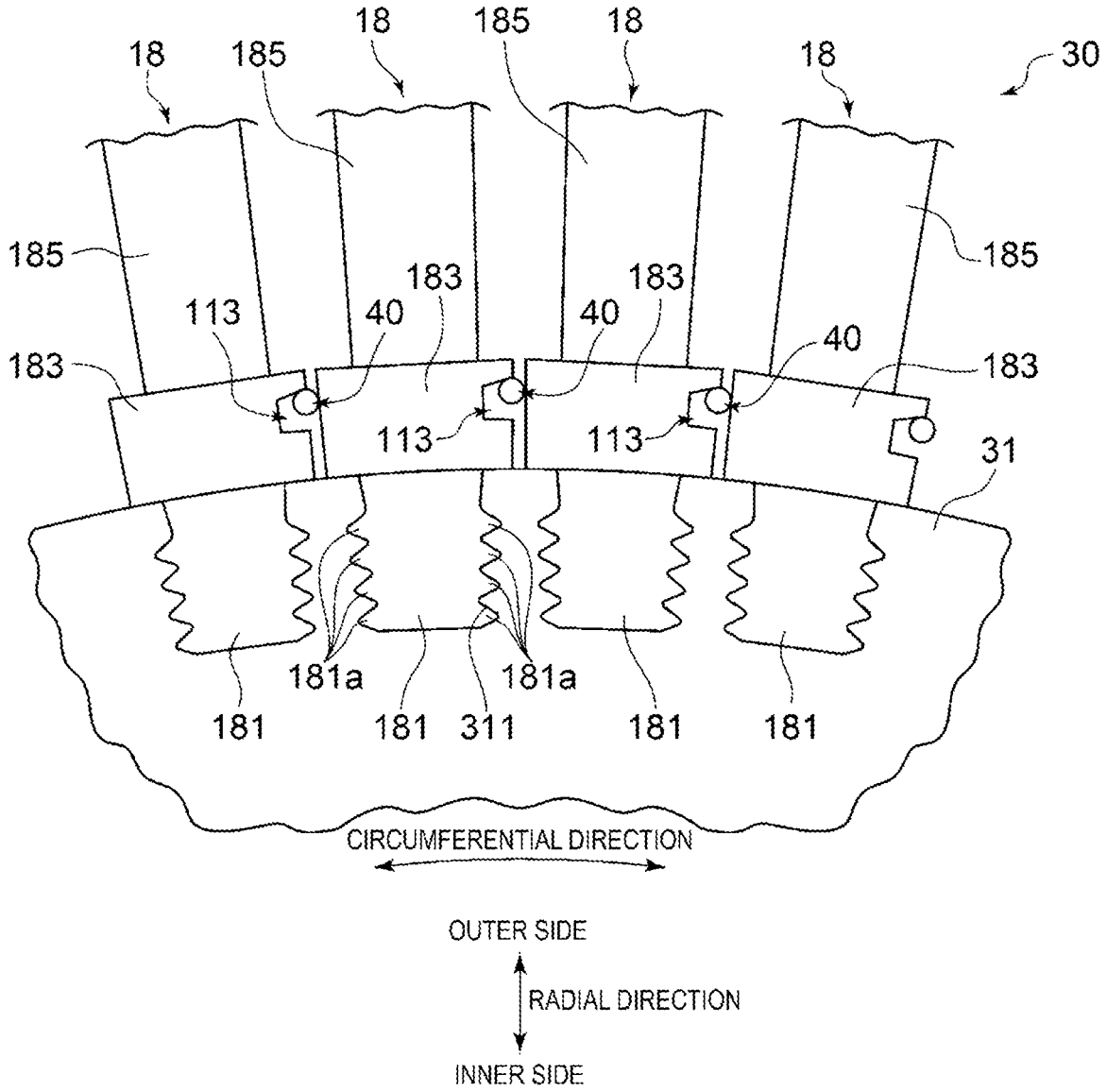
FIG. 2 is a diagram schematically illustrating a portion of a rotor disc with rotor blades attached.

FIG. 2 is a diagram schematically illustrating a portion of the rotor disc 31 with the rotor blades 18 attached. Note that in FIG. 2, the rotor blades 18 and the rotor disc 31 are illustrated in a cross-section taken along the radial direction.

As illustrated in FIG. 2, each rotor blade 18 according to some embodiments extends radially outward from the outer circumferential surface of the rotor disc 31. More specifically, each rotor blade 18 is attached to the rotor disc 31 by a blade root portion 181 of the rotor blade 18 being engaged with a groove 311 provided in the outer circumferential surface of the rotor disc 31.

Figure 3:
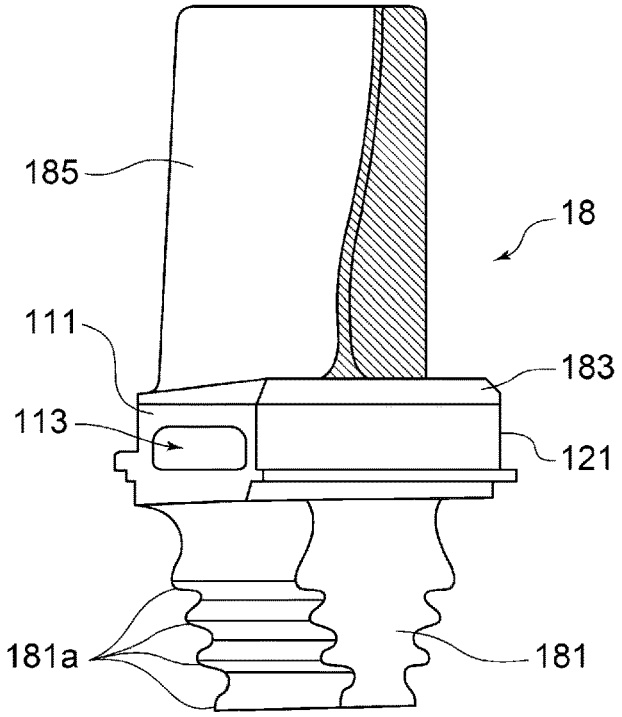
FIG. 3 is a schematic configuration diagram illustrating the configuration of a rotor blade according to some embodiments.

FIG. 3 is a schematic configuration diagram illustrating the configuration of the rotor blade 18 according to some embodiments.

As illustrated in FIG. 3, the rotor blade 18 includes the blade root portion 181, a platform 183, and an airfoil portion 185.

As described above, the blade root portion 181 engages with the groove 311 of the rotor disc 31 illustrated in FIG. 2, for example. Note that the blade root portion 181 may include a plurality of rib portions 181*a* protruding in the blade thickness direction.

The platform 183 is formed integrally with the blade root portion 181. In some embodiments, in the platform 183, a recess portion 113 is formed in a side surface 111, which is one of two side surfaces 111 and 121 that face the circumferential direction when the rotor blade 18 is attached to the rotor disc 31.

The airfoil portion 185 is erected on the platform 183 with the configuration described above.

Figure 4:
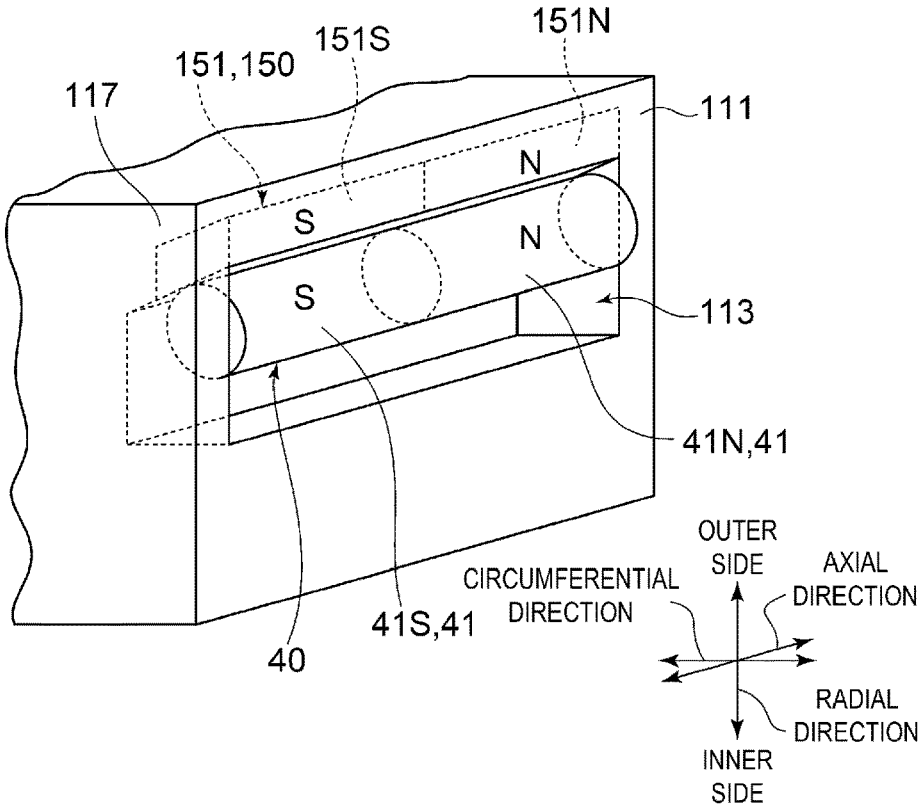
FIG. 4 is a schematic perspective view of the vicinity of a recess portion formed in a rotor blade.
Figure 5:
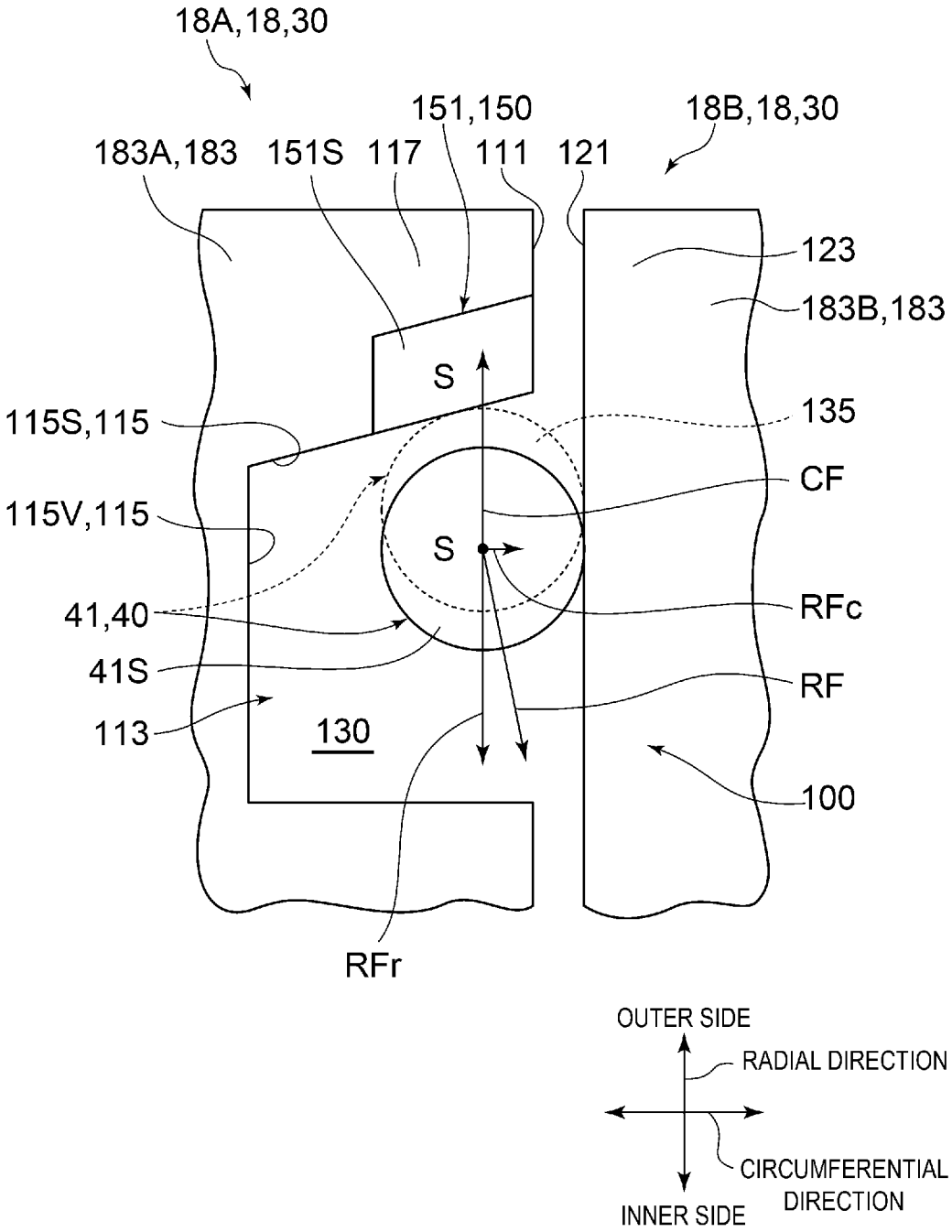
FIG. 5 is an enlarged schematic diagram of the vicinity of the recess portion in FIG. 2.

FIG. 4 is a schematic perspective view of the vicinity of the recess portion 113 formed in the rotor blade 18. FIG. 5 is an enlarged schematic diagram of the vicinity of the recess portion 113 in FIG. 2. Below, the vibration suppression device 100 according to some embodiments will be described with reference to mainly FIGS. 2, 4, and 5.

Damper Pin 40

In some embodiments, the vibration suppression device 100 is movably provided inside the gap 130 of the rotor 30 and is provided with the damper pin 40 that includes the magnet 41.

As illustrated in FIGS. 2 and 5, the damper pin 40 is provided between adjacent rotor blades 18 in the circumferential direction in contact with the rotor blades 18. The damper pin 40 is a cylindrical (pin-like) member. The damper pin 40 functions as a damper pin that damps the vibrations of the rotor blades 18 when the rotor 30 is rotating.

Figure 6:
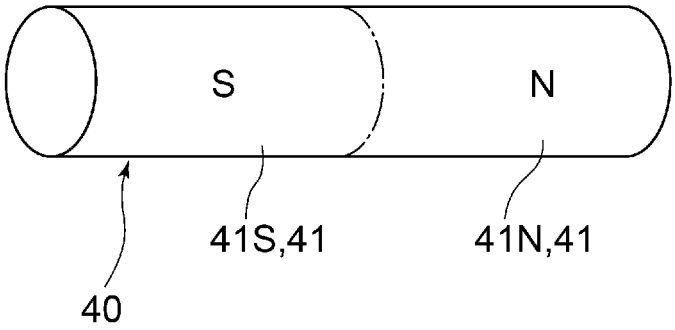
FIG. 6 is a schematic perspective view of a damper pin according to some embodiments.

FIG. 6 is a schematic perspective view of the damper pin 40 according to some embodiments. The damper pin 40 according to some embodiments includes the magnet 41. The magnet 41 of the damper pin 40 according to some embodiments is a permanent magnet having a cylindrical shape, with one side along the axial direction of the cylinder being a south pole 41S and the other side being a north pole 41N.

In the following description, for the sake of convenience, two rotor blades 18 adjacent in the circumferential direction from among the plurality of rotor blades 18 disposed in the circumferential direction of the center axis AX will be described. As appropriate, one of the rotor blades 18 will be referred to as a first rotor blade 18A, and, as appropriate, the rotor blade 18 disposed next to the first blade 18A with respect to the circumferential direction of the center axis AX will be referred to as a second rotor blade 18B. In the present embodiment, the first rotor blade 18A and the second rotor blade 18B have substantially the same structure.

The damper pin 40 is disposed between the platform 183 of the first rotor blade 18A and the platform 183 of the second rotor blade 18B. One side surface 111 of the platform 183 of the first rotor blade 18A faces the other side surface 121 of the platform 183 of the second rotor blade 18B. The platform 183 of the first rotor blade 18A and the platform 183 of the second rotor blade 18B face one another with a gap therebetween and not in contact. In the following description, as appropriate, the platform 183 of the first rotor blade 18A will be referred to as a first platform 183A, and, as appropriate, the platform 183 of the second rotor blade 18B will be referred to as a second platform 183B.

As illustrated in FIG. 5, the damper pin 40 is movably disposed in the gap 130 between the first rotor blade 18A (the first platform 183A) and the second rotor blade 18B (the second platform 183B). The gap 130 is the space surrounded by an inner surface 115 of the recess portion 113 provided in the first platform 183A and the side surface 121 provided on the second platform 183B.

The gap 130 is defined by the inner surface 115 of the recess portion 113 provided in the first platform 183A and the side surface 121 provided on the second platform 183B. The inner surface 115 and the side surface 121 face the gap 130. The damper pin 40 is capable of coming into contact with at least a portion of the inner surface 115 and the side surface 121.

The inner surface 115 includes a vertical surface 115V substantially parallel with the side surface 121 of the second platform 183B and a slanted surface 115S inclined with respect to the vertical surface 115V. The side surface 121 and the vertical surface 115V face one another with a gap therebetween. The side surface 121 and the vertical surface 115V are disposed aligned with the radial direction of the center axis AX. The slanted surface 115S is formed with the distance to the side surface 121 of the second platform 183B decreasing as it extends radially outward.

The slanted surface 115S of the first platform 183A is formed in a ceiling wall 117 that forms the boundary on the radially outward side of the gap 130.

Also, the side surface 121 of the second platform 183B is formed in a side wall 123 that forms the boundary in the circumferential direction of the gap 130.

In some embodiments, the vibration suppression device 100 is provided with the magnetic force generation portion 150 provided in the rotor 30 at the periphery of the gap 130.

In the embodiment illustrated in FIG. 5, the magnetic force generation portion 150 includes a ceiling magnetic force generation portion 151 provided in the ceiling wall 117 that forms a boundary on the radially outward side of the gap 130.

Figure 7:
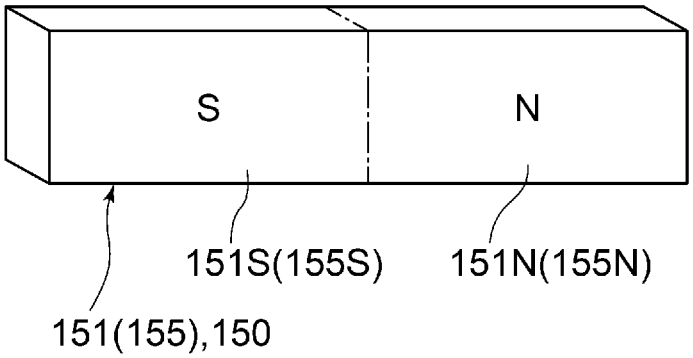
FIG. 7 is a schematic perspective view of a ceiling magnetic force generation portion illustrated in FIG. 5.

FIG. 7 is a schematic perspective view of the ceiling magnetic force generation portion 151 illustrated in FIG. 5. The ceiling magnetic force generation portion 151 illustrated in FIG. 7 is a permanent magnet having a columnar shape, for example, with one side along the axial direction of the column being a south pole 151S and the other side being a north pole 151N. The ceiling magnetic force generation portion 151 illustrated in FIG. 7, for example, has a rectangular columnar shape, but may have a circular columnar shape, may have a triangular columnar shape, or may have a polygonal columnar shape with a pentagonal or more sided shape.

In some embodiments, the magnetic force generation portion 150 is configured to exert, against the magnet 41 of the damper pin 40, a magnetic force in a direction pushing the damper pin 40 away from a stick region 135, described below, of the damper pin 40 located on the radially outward side of the gap 130 with respect to the rotor 30.

Specifically, as illustrated in FIG. 4, the damper pin 40 and the ceiling magnetic force generation portion 151 illustrated in FIG. 5 are disposed with the south pole 41S of the magnet 41 of the damper pin 40 and the south pole 151S of the ceiling magnetic force generation portion 151 facing one another in the radial direction and the north pole 41N of the magnet 41 of the damper pin 40 and the north pole 151N of the ceiling magnetic force generation portion 151 facing one another. Thus, the ceiling magnetic force generation portion 151 illustrated in FIG. 5 exerts, on the magnet 41 of the damper pin 40, a magnetic force in a direction radially inward, pushing the damper pin 40 away from the ceiling magnetic force generation portion 151.

In this way, the ceiling magnetic force generation portion 151 illustrated in FIG. 5 generates a repulsion force directed mainly radially inward against the magnet 41 of the damper pin 40.

The damper pin 40 is movably provided in the gap 130. When the rotor 30 rotates, centrifugal force CF acts on the damper pin 40. The centrifugal force CF causes the damper pin 40 to move radially outward.

When the centrifugal force CF acting on the damper pin 40 is less than a radial component RFr of a repulsion force RF between the ceiling magnetic force generation portion 151 and the magnet 41 of the damper pin 40, as illustrated by the solid line in FIG. 5, the damper pin 40 separates from the slanted surface 115S of the first platform 183A.

The repulsion force RF between the ceiling magnetic force generation portion 151 and the magnet 41 of the damper pin 40 is inversely proportional to the square of the distance between the ceiling magnetic force generation portion 151 and the damper pin 40. Thus, as the centrifugal force CF acting on the damper pin 40 increases, the distance between the damper pin 40 and the slanted surface 115S of the first platform 183A decreases.

Note that the repulsion force RF between the ceiling magnetic force generation portion 151 and the magnet 41 of the damper pin 40 includes a circumferential component RFc directed toward the side surface 121 of the second platform 183B. Thus, the damper pin 40 is pressed against the side surface 121 of the second platform 183B by the circumferential component RFc.

When the centrifugal force CF acting on the damper pin 40 is equal to or greater than the radial component RFr of a repulsion force RF between the ceiling magnetic force generation portion 151 and the magnet 41 of the damper pin 40, as illustrated by the dashed line in FIG. 5, the damper pin 40 comes into contact with the slanted surface 115S of the first platform 183A.

When the centrifugal force CF acting on the damper pin 40 is equal to or greater than the radial component RFr of the repulsion force RF between the ceiling magnetic force generation portion 151 and the magnet 41 of the damper pin 40, the damper pin 40 is pressed radially outward against the slanted surface 115S by a force corresponding to the centrifugal force CF minus the radial component RFr of the repulsion force RF. Note that the slanted surface 115S is inclined, decreasing the distance to the side surface 121 as it extends radially outward. Thus, when the centrifugal force CF acting on the damper pin 40 is equal to or greater than the radial component RFr of the repulsion force RF between the ceiling magnetic force generation portion 151 and the magnet 41 of the damper pin 40, the damper pin 40 moves to a position where it comes into contact with the slanted surface 115S and the side surface 121. This position is the most radially outward position of the damper pin 40 inside the gap 130.

Thus, as illustrated in FIG. 5 by the dashed line, the damper pin 40 comes into contact with the slanted surface 115S and the side surface 121 and is restricted from moving radially outward.

When the rotor 30 rotates, excitation force acts on the rotor blades 18 due to the contact between the air and the rotor blades 18, for example, and the rotor blades 18 may vibrate. Relative movement (friction) between the damper pin 40 and at least a portion of the inner surface 115 of the recess portion 113 and the side surface 121 in contact with one another causes damping of the vibration of the rotor blades 18.

When the centrifugal force CF acting on the damper pin 40 increases further, the damper pin 40 is pressed against the slanted surface 115S with an even greater force in a state where the movement of the damper pin 40 radially outward is restrict at the position illustrated by the dashed line in FIG. 5. Thus, if the value obtained by dividing the centrifugal force CF by an excitation force EF is excessively large, the frictional force of the damper pin 40 with the slanted surface 115S and the side surface 121 is excessive, and the damper pin 40 may be put in a stick state being unable to slip at the contact surface. When the damper pin 40 is in such a stick state, the vibration damping effect on the rotor blades due to the frictional force of the damper pin 40 with the slanted surface 115S and the side surface 121 decreases.

Note that the damper pin 40 may be in a stick state at the position indicated by the dashed line in FIG. 5, that is, in a position where the damper pin 40 is in contact with the slanted surface 115S and the side surface 121. In the following description, the region occupied by the damper pin 40 at a position where the damper pin 40 is in contact with the slanted surface 115S and the side surface 121 is referred to as the stick region 135.

According to the vibration suppression device 100 illustrated in FIG. 5, the magnetic force acts on the magnet 41 of the damper pin 40 in the direction pushing the damper pin 40 away from the stick region 135. Thus, the damper pin 40 is less likely to be in a stick state, and a decrease in the vibration damping effect can be minimized or prevented.

More specifically, in the vibration suppression device 100 illustrated in FIG. 5, the ceiling magnetic force generation portion 151 is configured to generate the repulsion force RF against the magnet 41, the repulsion force RF including a component (the radial component RFr) that is directed radially inward. In other words, in the vibration suppression device 100 illustrated in FIG. 5, the ceiling magnetic force generation portion 151 generates, against the magnet 41 of the damper pin 40, the repulsion force RF that decreases the centrifugal force CF acting on the damper pin 40. This makes it possible to reduce the force caused by the centrifugal force CF pressing the damper pin 40 against the slanted surface 115S. Thus, the damper pin 40 is less likely to be in a stick state, and a decrease in the vibration damping effect can be minimized or prevented.

Also, in the vibration suppression device 100 illustrated in FIG. 5, the ceiling magnetic force generation portion 151 generates the repulsion force RF against the magnet 41 of the damper pin 40, the repulsion force RF including the circumferential component RFc that is directed toward the side surface 121 of the second platform 183B. Thus, the damper pin 40 is pressed against the side surface 121 of the second platform 183B by the circumferential component RFc.

In the related art, the pressure acting to press the damper pin 40 toward the side surface 121 that extends in the radial direction is relatively small. However, with the circumferential component RFc, this pressure can be increased. In this way, the frictional force between the damper pin 40 and the side surface 121 can be increased, and thus the vibration damping effect can be improved.

Stick Region 135

Hereinafter, the stick region 135 will be described in further detail.

Figure 13:
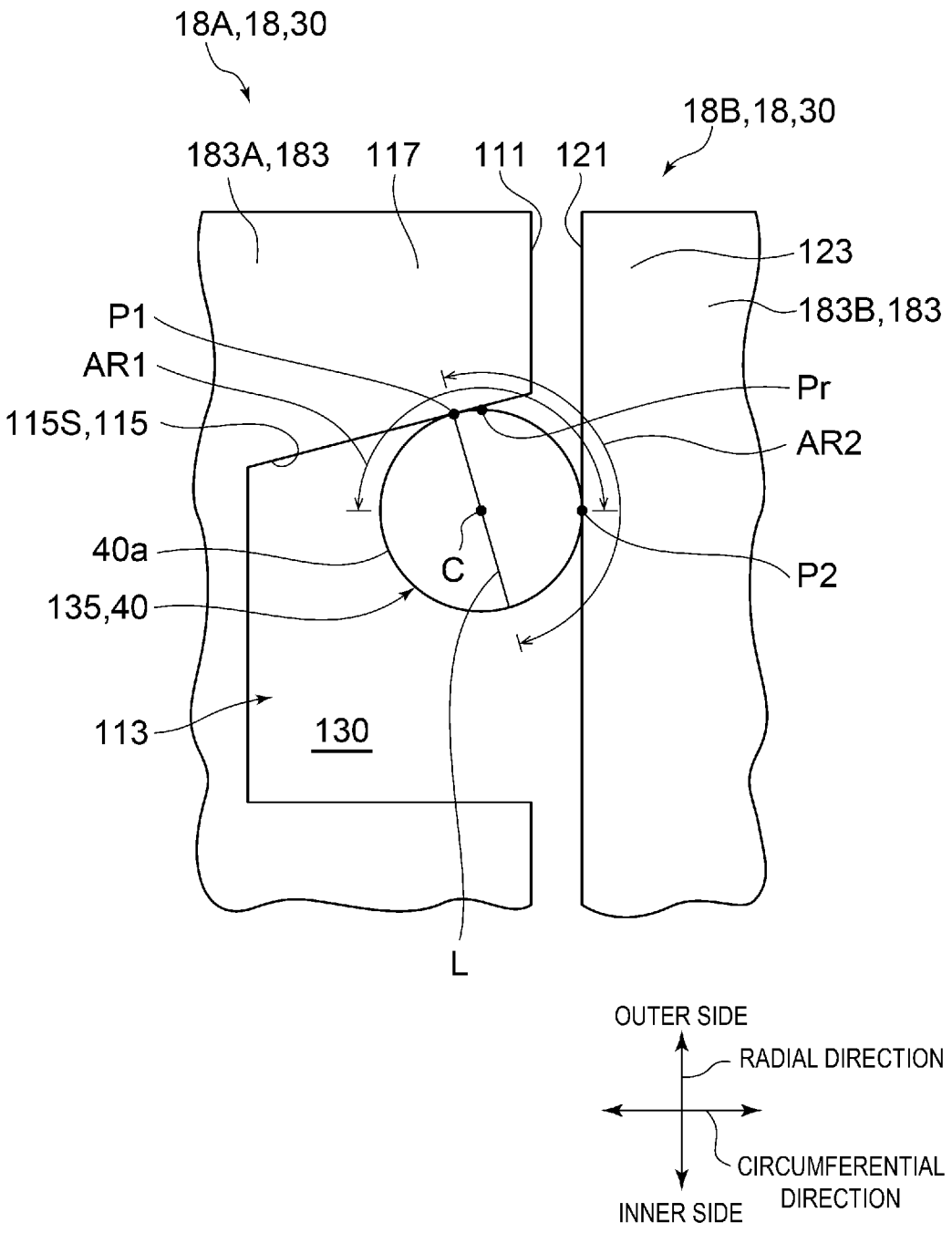
FIG. 13 is a schematic diagram for describing a stick region.

FIG. 13 is a schematic diagram for describing the stick region 135, and is an enlarged view of the vicinity of the recess portion 113. For the sake of convenience in the description, the magnetic force generation portion 150 is omitted from FIG. 13.

In some embodiments, the stick region 135 is the region occupied by the damper pin 40 when the damper pin 40 is disposed inside the gap 130 with an outer circumferential surface 40*a* of the damper pin 40 in contact with one or more wall surfaces (for example, the slanted surface 115S and the side surface 121) that define the gap 130 at, at least, a first point P1 and a second point P2 on the outer circumferential surface 40*a* of the damper pin 40 that satisfy the conditions (a) and (b) described below.

(a) The first point P1 is a point located on a semicircular arc AR1 of the outer circumferential surface 40*a* of the damper pin 40, which is further to the radially outward side than a center C of the damper pin 40.

(b) The second point P2 is a point located on a semicircular arc AR2 including a reference point Pr that is located furthest to the radially outward side on the outer circumferential surface 40*a*, the semicircular arc AR2 being one of two semicircular arcs obtained by dividing the outer circumferential surface 40*a* in two by a straight line L that connects the first point P1 and the center C.

In some embodiments, even in the case of receiving the centrifugal force CF directed radially outward, the damper pin 40 is restricted from moving radially outward by one or more wall surfaces the damper pin 40 is in contact with at the first point P1 and the second point P2 and the wall surfaces are pressed at the first point P1 and the second point P2 due to the centrifugal force CF.

However, in some embodiments, because the vibration suppression device 100 described above or below is provided, the damper pin 40 is unlikely to be in a stick state and a decrease in the vibration damping effect can be minimized or prevented.

Figure 8:
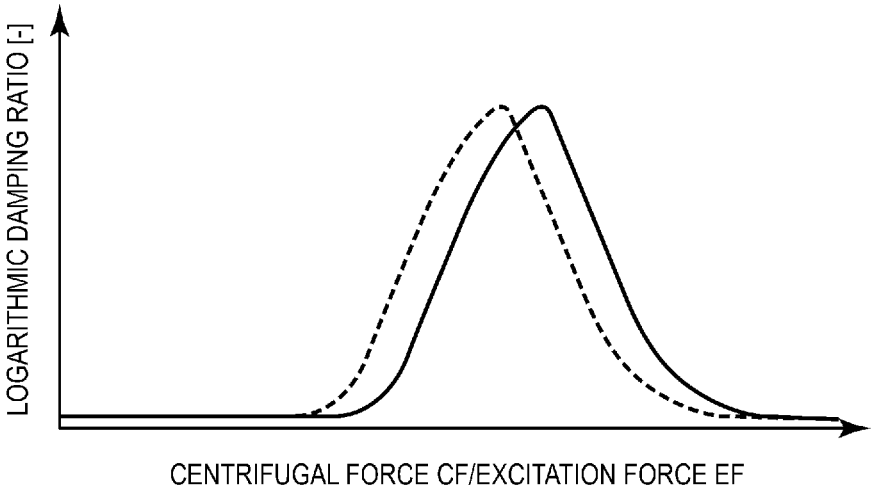
FIG. 8 is a diagram illustrating an example of the vibration characteristics of rotor blades provided with a vibration suppression device.

FIG. 8 is a diagram illustrating an example of the vibration characteristics of the rotor blades 18 of the compressor 2 provided with the vibration suppression device 100 illustrated in FIG. 5. In FIG. 8, the vibration characteristics of the rotor blades 18 of the compressor 2 provided with the vibration suppression device 100 illustrated in FIG. 5 are illustrated as a solid line. As a comparative example, the vibration characteristics of the rotor blades 18 not provided with the vibration suppression device 100 are indicated by a dashed line. In FIG. 8, the horizontal axis is a value (CF/EF) obtained by dividing the centrifugal force CF acting on the damper pin 40 by the excitation force EF acting on the rotor blades 18. In FIG. 8, the greater the centrifugal force CF, the greater the CF/EF.

In FIG. 8, the vertical axis indicates a logarithmic damping ratio due to friction related to the damper pin 40.

As illustrated in FIG. 8, as the CF/EF increases, the frictional force of the damper pin 40 with the slanted surface 115S and the side surface 121 increases, and thus the damping ratio increases. Furthermore, when CF/EF has a certain value, the damping ratio has a maximum value. However, when CF/EF further increases, the frictional force of the damper pin 40 with the slanted surface 115S and the side surface 121 further increases. This makes relative movement of the damper pin 40 to the slanted surface 115S and the side surface 121 difficult. Thus the damping ratio decreases. When the CF/EF further increases, the damper pin 40 is put in a stick state in which it is unable to slip at the contact surface.

In the vibration suppression device 100 illustrated in FIG. 5, the centrifugal force CF acting on the damper pin 40 is reduced by the repulsion force RF. Thus, as illustrated in FIG. 8, the curve of the damping ratio can be shifted in a direction (the right side in the drawing) in which CF/EF is overall increased.

Figure 9:
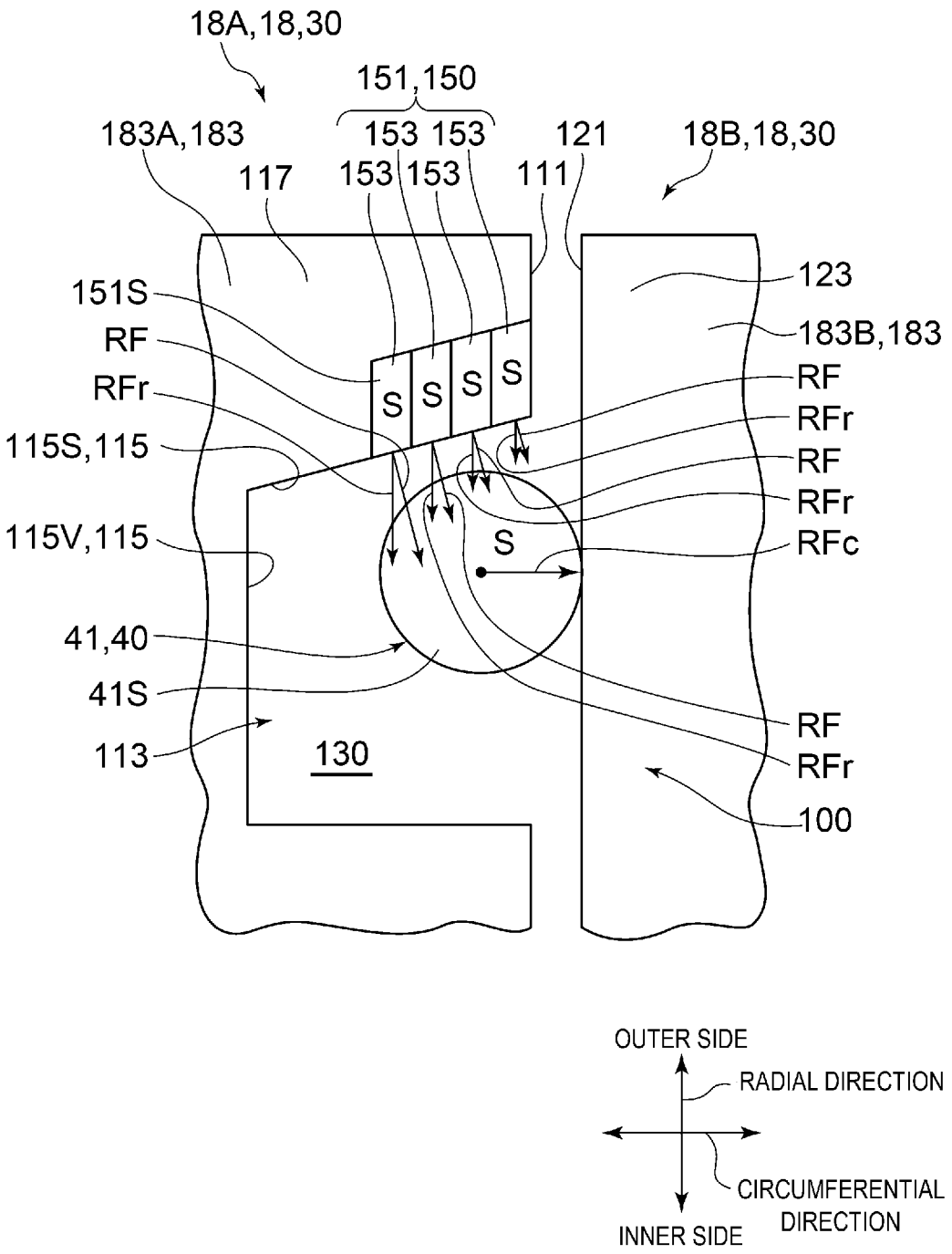
FIG. 9 is an enlarged schematic diagram of the vicinity of a recess portion of a compressor provided with a vibration suppression device according to another embodiment.

FIG. 9 is an enlarged schematic diagram of the vicinity of the recess portion 113 of the compressor 2 provided with the vibration suppression device 100 according to another embodiment. Note that, in the following description, components that are the same as those of the configuration according to the embodiment illustrated in FIG. 5 are denoted by the same reference signs and detailed descriptions thereof will be omitted. Also, mainly the differences from the configuration according to the embodiment illustrated in FIG. 5 will be described.

In the embodiment illustrated in FIG. 9, the ceiling magnetic force generation portion 151 is configured to generate the repulsion force RF against the magnet 41, the component (the radial component RFr) of the repulsion force RF directed radially inward increasing with being further away from the stick region 135 (see FIG. 5) in the circumferential direction.

For example, in the embodiment illustrated in FIG. 9, the ceiling magnetic force generation portion 151 includes a plurality of magnets 153 arranged in the circumferential direction. The magnetic forces of each of the plurality of magnets 153 are different. The magnetic forces of each of the plurality of magnets 153 increases in the circumferential direction from the second rotor blade 18B toward the first rotor blade 18A. By arranging the plurality of magnets 153 with different magnetic forces in the manner described above, the repulsion force RF having a component (the radial component RFr) directed radially inward increasing with being further away from the stick region 135 (see FIG. 5) in the circumferential direction can be generated against the magnet 41. Note that the repulsion force RF having the radial component RFr increasing with being further away from the stick region 135 in the circumferential direction may be generated against the magnet 41 by a single magnet.

By generating, against the magnet 41, the repulsion force RF having the radial component RFr increasing with being further away from the stick region 135 in the circumferential direction, the circumferential component RFc can be effectively increased. In other words, in the embodiment illustrated in FIG. 9, the ceiling magnetic force generation portion 151 creates a magnetic field by generating, against the magnet 41, the repulsion force RF having the radial component RFr increasing with being further away from the stick region 135 in the circumferential direction. In this way, the circumferential component RFc of the repulsion force RF the magnet 41 receives from the magnetic field is directed in a direction towards the stick region 135, or in other words, a direction from the first rotor blade 18A toward the second rotor blade 18B.

As such, the magnet 41 receives a repulsive force (the circumferential component RFc) directed in the circumferential direction from the first rotor blade 18A toward the second rotor blade 18B. In the case in which a wall portion is provided that forms a boundary in the circumferential direction of the gap 130 toward which the magnet 41 moves when a repulsion force is received, the damper pin 40 is pressed by the repulsion force toward the wall portion. In the embodiment illustrated in FIG. 9, the side wall 123 is present, the side wall 123 being a wall portion that forms a boundary in the circumferential direction of the gap 130 toward which the magnet 41 moves when a repulsion force is received. Thus, according to the embodiment illustrated in FIG. 9, frictional force is obtained when the damper pin 40 slides on the side surface 121, this frictional force allowing a vibration damping effect to be obtained.

Figure 10:
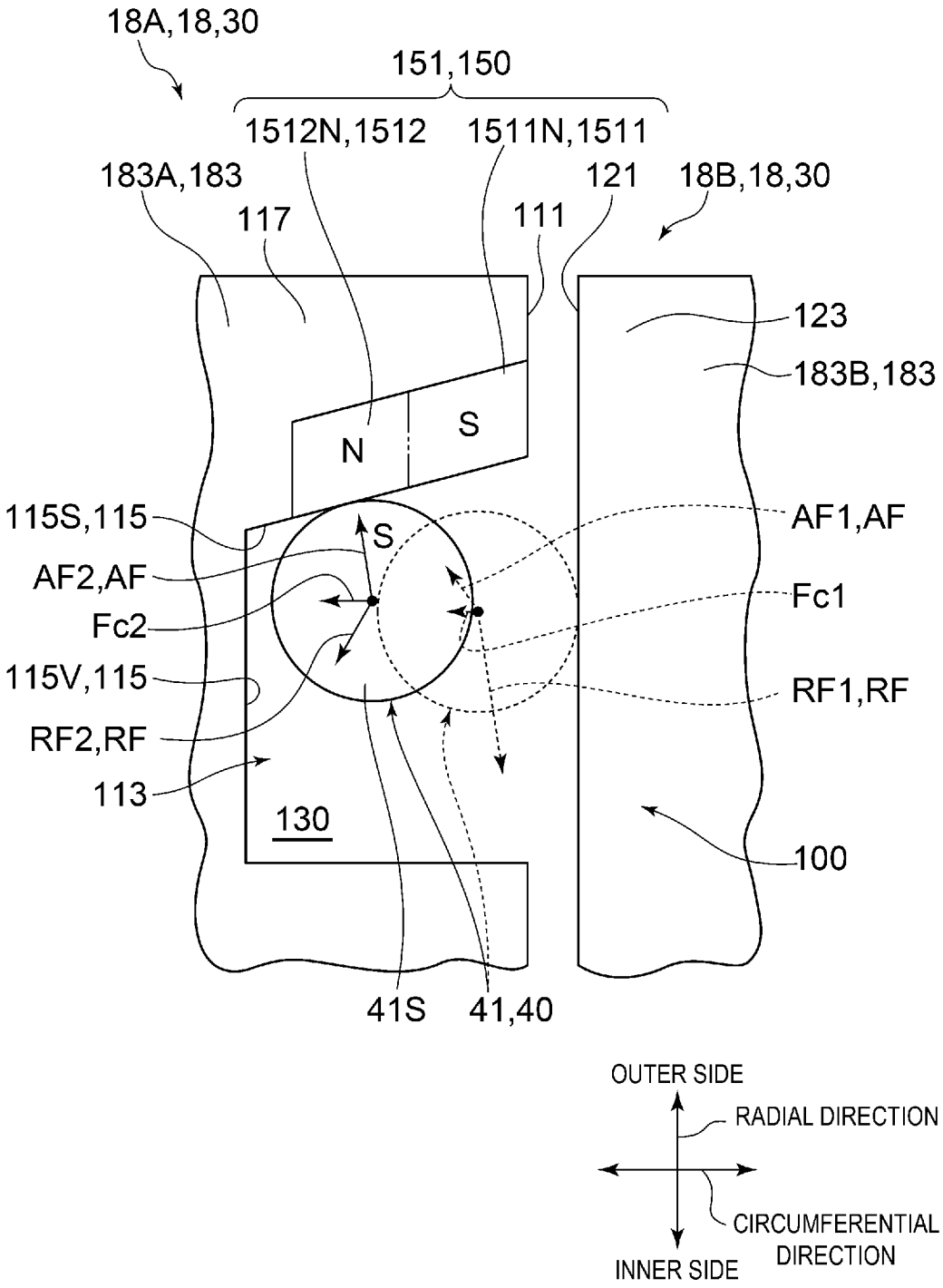
FIG. 10 is an enlarged schematic diagram of the vicinity of a recess portion of a compressor provided with a vibration suppression device according to yet another embodiment.

FIG. 10 is an enlarged schematic diagram of the vicinity of the recess portion 113 of the compressor 2 provided with the vibration suppression device 100 according to yet another embodiment. Note that, in the following description, components that are the same as those of the configuration according to the embodiments illustrated in FIG. 5 or FIG. 9 are denoted by the same reference signs and detailed descriptions thereof will be omitted. Also, mainly the differences from the configuration according to the embodiments illustrated in FIG. 5 or FIG. 9 will be described.

In the embodiment illustrated in FIG. 10, the ceiling magnetic force generation portion 151 includes a first ceiling magnetic force generation portion 1511 and a second ceiling magnetic force generation portion 1512. The first ceiling magnetic force generation portion 1511 generates the repulsion force RF against the magnet 41, the repulsion force RF including a component (the radial component RFr) that is directed radially inward. The second ceiling magnetic force generation portion 1512 is provided at a position separated in the circumferential direction further away from the stick region 135 than the first ceiling magnetic force generation portion 1511 and generates, against the magnet 41, an attraction force AF including a component directed toward the second ceiling magnetic force generation portion 1512.

Figure 11:
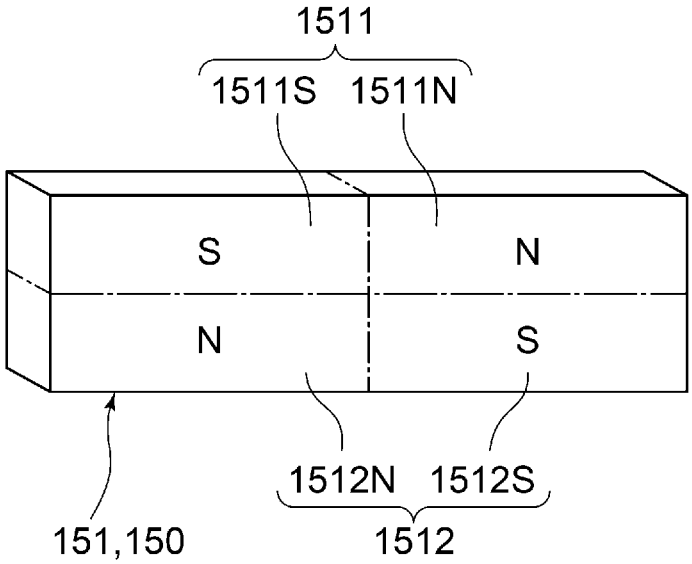
FIG. 11 is a schematic perspective view of a ceiling magnetic force generation portion illustrated in FIG. 10.

FIG. 11 is a schematic perspective view of the ceiling magnetic force generation portion 151 illustrated in FIG. 10. The ceiling magnetic force generation portion 151 illustrated in FIG. 11 is a permanent magnet having a columnar shape, for example. The ceiling magnetic force generation portion 151 illustrated in FIG. 11, for example, has a rectangular columnar shape, but may have a circular columnar shape, may have a triangular columnar shape, or may have a polygonal columnar shape with a pentagonal or more sided shape.

In the ceiling magnetic force generation portion 151 illustrated in FIG. 11, the first ceiling magnetic force generation portion 1511 includes a south pole 1511S and a north pole 1511N. In the ceiling magnetic force generation portion 151 illustrated in FIG. 11, the second ceiling magnetic force generation portion 1512 includes a south pole 1512S and a north pole 1512N. In the ceiling magnetic force generation portion 151 illustrated in FIG. 11, the first ceiling magnetic force generation portion 1511 with a rectangular columnar shape, for example, and the second ceiling magnetic force generation portion 1512 with a rectangular columnar shape, for example, form a shape with the side surfaces of the columnar shapes opposing one another. The ceiling magnetic force generation portion 151 illustrated in FIG. 11 has a shape in which the south pole 1511S of the first ceiling magnetic force generation portion 1511 and the north pole 1512N of the second ceiling magnetic force generation portion 1512 oppose one another and the north pole 1511N of the first ceiling magnetic force generation portion 1511 and the south pole 1512S of the second ceiling magnetic force generation portion 1512 oppose one another.

As illustrated in FIG. 10, in the ceiling magnetic force generation portion 151 illustrated in FIG. 11, the south pole 1511S of the first ceiling magnetic force generation portion 1511 and the south pole 41S of the magnet 41 of the damper pin 40 are disposed allowed to oppose one another in the radial direction. As illustrated in FIG. 10, in the ceiling magnetic force generation portion 151 illustrated in FIG. 11, the north pole 1512N of the second ceiling magnetic force generation portion 1512 and the south pole 41S of the magnet 41 of the damper pin 40 are disposed allowed to oppose one another in the radial direction.

Note that, though not illustrated in FIG. 10, in the ceiling magnetic force generation portion 151 illustrated in FIG. 11, the north pole 1511N of the first ceiling magnetic force generation portion 1511 and the north pole 41N of the magnet 41 of the damper pin 40 are disposed allowed to oppose one another in the radial direction. Also, though not illustrated in FIG. 10, in the ceiling magnetic force generation portion 151 illustrated in FIG. 11, the south pole 1512S of the second ceiling magnetic force generation portion 1512 and the north pole 41N of the magnet 41 of the damper pin 40 are disposed allowed to oppose one another in the radial direction.

In the vibration suppression device 100 illustrated in FIG. 10, when the damper pin 40 attempts to move to the stick region 135 (see FIG. 5) by the centrifugal force CF due to the rotation of the rotor 30, as indicated by the dashed line, the magnet 41 receives a repulsion force RF1 from the first ceiling magnetic force generation portion 1511 directed radially inward as illustrated in by the dashed line arrow. Also, the magnet 41 receives an attraction force AF1 from the second ceiling magnetic force generation portion 1512 directed toward the second ceiling magnetic force generation portion 1512 located more radially outward than the magnet 41. At this time, depending on the position of the magnet 41, the resultant force of the repulsion force RF1 and the attraction force AF1 may include a circumferential component Fc1 in the circumferential direction directed in the direction away from the side surface 121 of the second platform 183B.

When the damper pin 40 moves toward the second ceiling magnetic force generation portion 1512 in the circumferential direction to a position away from the first ceiling magnetic force generation portion 1511 due to the circumferential component Fc1 or the vibration of the rotor 30, the repulsion force RF1 against the magnet 41 from the first ceiling magnetic force generation portion 1511 is weakened and the attraction force AF1 from the second ceiling magnetic force generation portion 1512 is strengthened. As a result, the damper pin 40 comes into contact with the slanted surface 115S in the vicinity of the second ceiling magnetic force generation portion 1512 and slides on the slanted surface 115S in the circumferential direction toward the second ceiling magnetic force generation portion 1512.

In addition, when the damper pin 40 approaches the second ceiling magnetic force generation portion 1512 illustrated by the solid line, the resultant force of an attraction force AF2 against the magnet 41 from the second ceiling magnetic force generation portion 1512 and a repulsion force RF2 from the first ceiling magnetic force generation portion 1511 includes a circumferential component Fc2 directed in the circumferential direction away from the side surface 121 of the second platform 183B. Thus, according to the vibration suppression device 100 illustrated in FIG. 10, compared with a configuration in which the second ceiling magnetic force generation portion 1512 is not provided, the distance the damper pin 40 slides on the slanted surface 115S can be increased. This allows a vibration damping effect due to the frictional force from sliding on the slanted surface 115S to be obtained.

Figure 12:
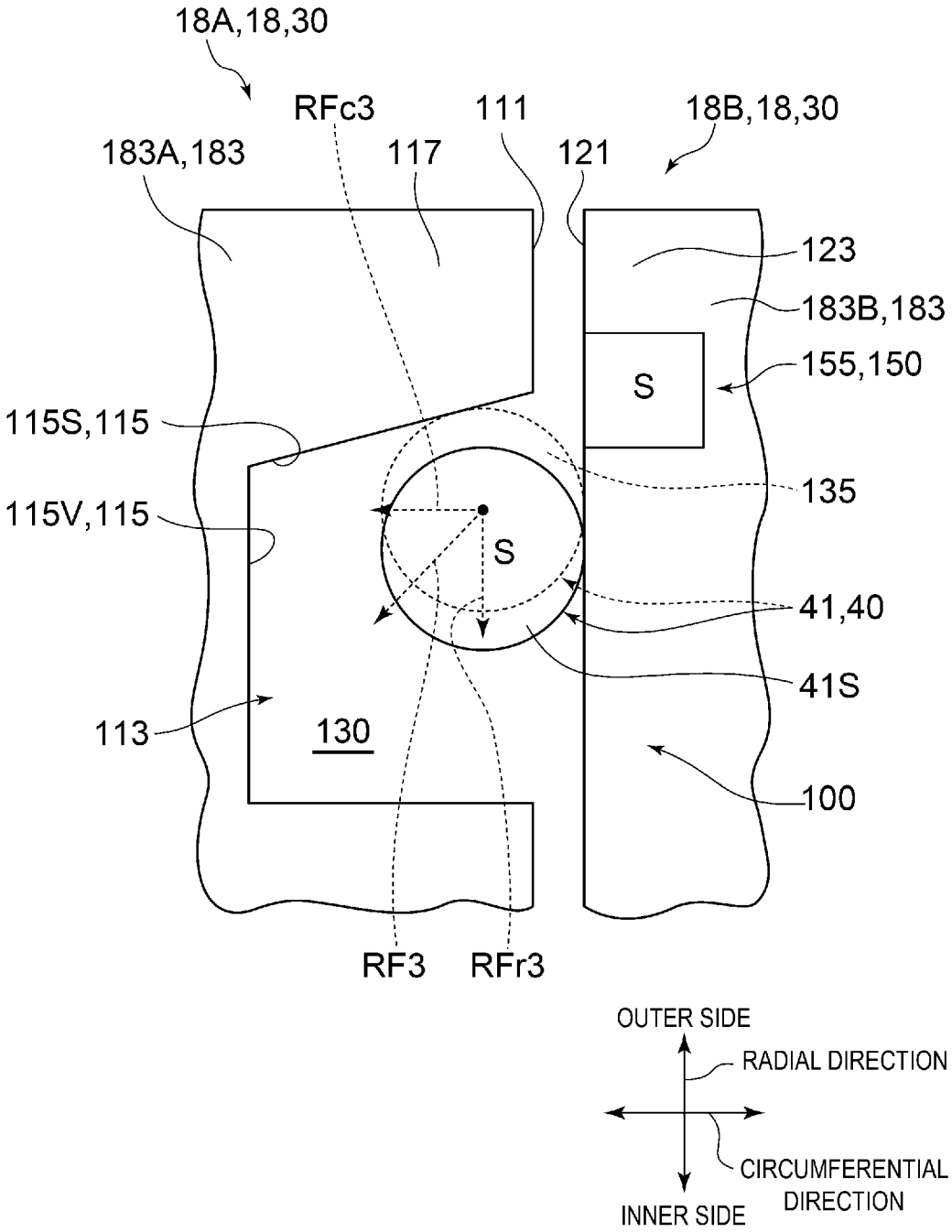
FIG. 12 is an enlarged schematic diagram of the vicinity of a recess portion of a compressor provided with a vibration suppression device according to yet another embodiment.

FIG. 12 is an enlarged schematic diagram of the vicinity of the recess portion 113 of the compressor 2 provided with the vibration suppression device 100 according to yet another embodiment. Note that, in the following description, components that are the same as those of the configuration according to the embodiments illustrated in FIG. 5, FIG. 9, or FIG. 10 are denoted by the same reference signs and detailed descriptions thereof will be omitted. Also, mainly the differences from the configuration according to the embodiments illustrated in FIG. 5, FIG. 9, or FIG. 10 will be described.

In the embodiment illustrated in FIG. 12, the magnetic force generation portion 150 includes a side wall magnetic force generation portion 155 provided in the side wall 123 that forms a boundary in the circumferential direction of the gap 130.

In the embodiment illustrated in FIG. 12, the side wall magnetic force generation portion 155 may have the same configuration as the ceiling magnetic force generation portion 151 illustrated in FIG. 7, for example. In other words, the side wall magnetic force generation portion 155 is a permanent magnet having a columnar shape, for example, with one side along the axial direction of the column being a south pole 155S and the other side being a north pole 155N. In the embodiment illustrated in FIG. 12, the side wall magnetic force generation portion 155, for example, has a rectangular columnar shape, but may have a circular columnar shape, may have a triangular columnar shape, or may have a polygonal columnar shape with a pentagonal or more sided shape.

In the embodiment illustrated in FIG. 12, the damper pin 40 and the side wall magnetic force generation portion 155 are disposed with the south pole 41S of the magnet 41 of the damper pin 40 and the south pole 155S of the side wall magnetic force generation portion 155 facing one another in the circumferential direction. In the embodiment illustrated in FIG. 12, though not illustrated in FIG. 12, the damper pin 40 and the side wall magnetic force generation portion 155 are disposed with the north pole 41N of the magnet 41 of the damper pin 40 and the north pole 155N of the side wall magnetic force generation portion 155 facing one another.

In the embodiment illustrated in FIG. 12, the side wall magnetic force generation portion 155 exerts, on the magnet 41 of the damper pin 40, a magnetic force in a direction radially inward, pushing the damper pin 40 away from the side wall magnetic force generation portion 155.

Specifically, in the embodiment illustrated in FIG. 12, the side wall magnetic force generation portion 155 generates a repulsion force RF3 against the magnet 41 of the damper pin 40, the repulsion force RF3 including a component (a radial component RFr3) directed radially inward and a circumferential component RFc3 directed in the circumferential direction away from the side surface 121 of the second platform 183B.

In other words, in the embodiment illustrated in FIG. 12, the side wall magnetic force generation portion 155 is configured to generate the repulsion force RF3 against the magnet 41, the repulsion force RF3 including a component (the radial component RFr3) directed radially inward and a component (the circumferential component RFc3) directed in the circumferential direction away from the stick region 135.

In the embodiment illustrated in FIG. 12, the side wall magnetic force generation portion 155 is disposed in the vicinity of the stick region 135. In the embodiment illustrated in FIG. 12, the side wall magnetic force generation portion 155 may be disposed in the vicinity of the boundary between the slanted surface 115S and the side surface 111 in the side wall 123 so that the side wall magnetic force generation portion 155 generates the repulsion force RF3 including a component (the radial component RFr3) directed radially inward against the magnet 41 of the damper pin 40 located in the stick region 135.

In the embodiment illustrated in FIG. 12, the magnetic force generated by the side wall magnetic force generation portion 155 can push the damper pin 40 away from the stick region 135. This makes it less likely for the damper pin 40 to be in a stick state, and a decrease in the vibration damping effect can be further minimized or prevented.

Also, in the embodiment illustrated in FIG. 12, the damper pin 40 can be pushed away from the stick region 135 by a component (the radial component RFr3) directed radially inward of the repulsion force RF3 from the side wall magnetic force generation portion 155. This makes it less likely for the damper pin 40 to be in a stick state, and a decrease in the vibration damping effect can be minimized or prevented.

Also, in the embodiment illustrated in FIG. 12, the damper pin 40 can easily slide on the slanted surface 115S due to a component (the circumferential component RFc3) in the circumferential direction directed away from the stick region 135 of the repulsion force RF3 from the side wall magnetic force generation portion 155. Thus, in the embodiment illustrated in FIG. 12, the distance the damper pin 40 slides on the slanted surface 115S can be increased. This allows a vibration damping effect due to the frictional force from sliding on the slanted surface 115S to be obtained.

Note that the side wall magnetic force generation portion 155 illustrated in FIG. 12 may be disposed together with the ceiling magnetic force generation portion 151 illustrated in FIG. 5, FIG. 9, or FIG. 10 or may be disposed individually.

Note that the side wall magnetic force generation portion 155 may be disposed in the side wall 123 at least further radially inward than the stick region 135 and may be configured to generate against the magnet 41 an attraction force including a component directed radially inward. With such a side wall magnetic force generation portion 155, a magnetic force in a direction that pushes the damper pin 40 away from the stick region 135 acts against the magnet 41. Also, such a side wall magnetic force generation portion 155 may be disposed together with the ceiling magnetic force generation portion 151 illustrated in FIG. 5, FIG. 9, or FIG. 10 or may be disposed individually.

The present disclosure is not limited to the embodiments described above, and also includes a modification of the above-described embodiments as well as appropriate combinations of these modes.

For example, in some embodiments described above, a permanent magnet is used as the magnetic force generation portion 150. However, an electromagnet may be used.

In some embodiments described above, the recess portion 113 is provided in only the side surface 111 from among the two side surfaces 111 and 121. However, the recess portion 113 may be also provided in only the other side surface 121 or may be provided in both side surfaces 111 and 121.

In the case in which the recess portion 113 is provided in both side surfaces 111 and 121, the gap 130 is preferably formed by the recess portion 113 in the first platform 183A and the recess portion 113 in the second platform 183B. Then, the damper pin 40 is preferably disposed in the gap 130. The ceiling magnetic force generation portion 151 is preferably provided in both the ceiling wall 117 of the first platform 183A and the ceiling wall 117 of the second platform 183B.

The contents of the embodiments described above can be construed as follows, for example.

(1) A vibration suppression device 100 for a rotary machine according to at least one embodiment of the present disclosure is a vibration suppression device for a rotor of a rotary machine, including a damper pin 40 movably provided inside a gap 130 of the rotor 30, the damper pin 40 including a magnet 41, and a magnetic force generation portion 150 provided in the rotor 30 at a periphery of the gap 130. The magnetic force generation portion 150 is configured to exert, against the magnet 41, a magnetic force in a direction pushing the damper pin 40 away from a stick region 135 of the damper pin 40 located on a radially outward side of the rotor 30 in the gap 130.

According to the configuration of (1) described above, the magnetic force acts on the magnet 41 in the direction pushing the damper pin 40 away from the stick region 135. Thus, the damper pin 40 is less likely to be in a stick state, and a decrease in the vibration damping effect can be minimized or prevented.

(2) In the configuration of (1) described above, according to some embodiments, the magnetic force generation portion 150 includes a ceiling magnetic force generation portion 151 provided in a ceiling wall 117 that forms a boundary on a radially outward side of the gap 130.

The damper pin 40 moves radially outward due to the centrifugal force CF from the rotor 30 rotating. According to the configuration of (2) described above, the ceiling magnetic force generation portion 151 is disposed on the radially outward side of the gap 130. Thus, the ceiling magnetic force generation portion 151 can effectively exert a magnetic force against the magnet 41 of the damper pin 40.

(3) In the configuration of (2) described above, according to some embodiments, the ceiling magnetic force generation portion 151 is configured to generate, against the magnet 41, a repulsion force RF including a component (a radial component RFr) directed radially inward.

According to the configuration of (3) described above, the repulsion force RF can push the damper pin 40 away from the stick region 135.

(4) In the configuration of (3) described above, in some embodiments, the ceiling magnetic force generation portion 151 is configured to generate, against the magnet 41, a repulsion force RF having a component (the radial component RFr) directed radially inward increasing with being further away from the stick region 135 in a circumferential direction of the rotor 30.

According to the configuration of (4) described above, the ceiling magnetic force generation portion 151 creates a magnetic field so that the repulsion force RF described above is generated against the magnet 41. Thus, the circumferential component RFc of the repulsion force RF the magnet 41 receives from the magnetic field is directed in a direction towards the stick region 135. As such, the magnet 41 receives a repulsive force (the circumferential component RFc) directed toward the stick region 135 in the circumferential direction, or in other words, a direction from the first rotor blade 18A toward the second rotor blade 18B. In the case in which a wall portion (for example, a side wall 123) is provided that forms a boundary in the circumferential direction of the gap 130 toward which the magnet 41 moves when a repulsion force is received, the damper pin 40 is pressed by the repulsion force toward the wall portion. Thus, according to the configuration of (4) described above, frictional force is obtained when the damper pin 40 slides on the wall portion (on the side surface 121), this frictional force allowing a vibration damping effect to be obtained.

(5) In the configuration of (2) described above, in some embodiments, the ceiling magnetic force generation portion 151 includes a first ceiling magnetic force generation portion 1511 and a second ceiling magnetic force generation portion 1512. The first ceiling magnetic force generation portion 1511 generates the repulsion force RF against the magnet 41, the repulsion force RF including a component (the radial component RFr) that is directed radially inward. The second ceiling magnetic force generation portion 1512 is provided at a position separated in the circumferential direction of the rotor 30 further away from the stick region 135 than the first ceiling magnetic force generation portion 1511 and generates, against the magnet 41, an attraction force AF including a component directed toward the second ceiling magnetic force generation portion 1512.

According to the configuration of (5) described above, when the damper pin 40 attempts to move to the stick region 135 due to the centrifugal force CF from the rotation of the rotor 30, the magnet 41 receives a repulsion force directed radially inward from the first ceiling magnetic force generation portion 1511. At this time, when the damper pin 40 moves toward the second ceiling magnetic force generation portion 1512 in the circumferential direction to a position away from the first ceiling magnetic force generation portion 1511 due to the vibration of the rotor 30, the repulsion force RF against the magnet 41 from the first ceiling magnetic force generation portion 1511 is weakened and the attraction force AF from the second ceiling magnetic force generation portion 1512 is strengthened. As a result, the damper pin 40 comes into contact with the ceiling wall 117 in the vicinity of the second ceiling magnetic force generation portion 1512 and slides on the wall surface (slanted surface 115S) of the ceiling wall 117 in the circumferential direction toward the second ceiling magnetic force generation portion 1512. Thus, according to the configuration of (5) described above, compared with a configuration in which the second ceiling magnetic force generation portion 1512 is not provided, the distance the damper pin 40 slides on the slanted surface 115S can be increased. This allows a vibration damping effect due to the frictional force from sliding on the slanted surface 115S to be obtained.

(6) In the configuration of any one of (1) to (5) described above, in some embodiments, the magnetic force generation portion 150 includes a side wall magnetic force generation portion 155 provided in a side wall 123 that forms a boundary in a circumferential direction of the gap 130.

According to the configuration of (6) described above, the magnetic force generated by the side wall magnetic force generation portion 155 can push the damper pin 40 away from the stick region 135. This makes it less likely for the damper pin 40 to be in a stick state, and a decrease in the vibration damping effect can be further minimized or prevented.

(7) In the configuration of (6) described above, in some embodiments, the side wall magnetic force generation portion 155 is configured to generate, against the magnet 41, a repulsion force RF3 including a component (radial component RFr3) directed radially inward and a component (circumferential component RFc3) directed in a circumferential direction of the rotor 30 away from the stick region 135.

According to the configuration of (7) described above, the damper pin 40 can be pushed away from the stick region 135 by a component (the radial component RFr3) directed radially inward of the repulsion force RF3 from the side wall magnetic force generation portion 155. This makes it less likely for the damper pin 40 to be in a stick state, and a decrease in the vibration damping effect can be minimized or prevented.

Also, according to the configuration of (7) described above, the damper pin 40 can easily slide on a wall surface (the slanted surface 115S) of the ceiling wall 117 due to a component (the circumferential component RFc3) in the circumferential direction of the rotor 30 directed away from the stick region 135 of the repulsion force RF3 from the side wall magnetic force generation portion 155. Thus, according to the configuration of (7) described above, the distance the damper pin 40 slides on the slanted surface 115S can be increased. This allows a vibration damping effect due to the frictional force from sliding on the slanted surface 115S to be obtained.

(8) In the configuration of any one of (1) to (7) described above, in some embodiments, the stick region 135 is the region occupied by the damper pin 40 when the damper pin 40 is disposed inside the gap 130 with an outer circumferential surface 40*a* of the damper pin 40 in contact with one or more wall surfaces (for example, the slanted surface 115S and the side surface 121) that define the gap 130 at, at least, a first point P1 and a second point P2 on the outer circumferential surface 40*a* of the damper pin 40 that satisfy the conditions (a) and (b) described below.

(a) The first point P1 is a point located on a semicircular arc AR1 of the outer circumferential surface 40*a* of the damper pin 40, which is further to the radially outward side of the rotor 30 than a center C of the damper pin 40.

(b) The second point P2 is a point located on a semicircular arc AR2 including a reference point Pr that is located furthest to the radially outward side of the rotor 30 on the outer circumferential surface 40*a*, the semicircular arc AR2 being one of two semicircular arcs obtained by dividing the outer circumferential surface 40*a* in two by a straight line L that connects the first point P1 and the center C.

According to the configuration of (8) described above, even in the case of receiving the centrifugal force CF directed radially outward, the damper pin 40 is restricted from moving radially outward by one or more wall surfaces the damper pin 40 is in contact with at the first point P1 and the second point P2 and the wall surfaces are pressed at the first point P1 and the second point P2 due to the centrifugal force CF.

However, according to the configuration of (8) described above, because the configuration of (1) described above is provided, the damper pin 40 is less likely to be in a stick state and a decrease in the vibration damping effect can be minimized or prevented.

(9) A rotary machine (the compressor 2) according to at least one embodiment of the present disclosure includes a rotor 30, and a vibration suppression device 100 for a rotary machine with the configuration of any one of (1) to (8) described above.

According to the configuration of (9) described above, the damper pin 40 is less likely to be in a stick state and a decrease in the vibration damping effect can be minimized or prevented. Thus, the vibration of the rotary machine (the compressor 2) can be minimized or prevented.

While preferred embodiments of the invention have been described as above, it is to be understood that variations and modifications will be apparent to those skilled in the art without departing from the scope and spirits of the invention. The scope of the invention, therefore, is to be determined solely by the following claims.

The invention claimed is:

1. A rotor for a rotary machine comprising a vibration suppression device, the vibration suppression device comprising:

a damper pin movably provided inside a gap of the rotor, the damper pin including a magnet; and a magnetic force generation portion provided in the rotor at a periphery of the gap, wherein the magnetic force generation portion is configured to exert, against the magnet, a magnetic force in a direction pushing the damper pin away from a stick region of the damper pin located on a radially outward side of the rotor in the gap.

2. The rotor according to claim 1, wherein the magnetic force generation portion includes a ceiling magnetic force generation portion provided in a ceiling wall that forms a boundary on the radially outward side of the gap.

3. The rotor according to claim 2, wherein the ceiling magnetic force generation portion is configured to generate, against the magnet, a repulsion force including a component directed radially inward.

4. The rotor according to claim 3, wherein the radially inward component of the repulsion force increases with distance from the stick region in a circumferential direction of the rotor.

5. The rotor according to claim 2, wherein the ceiling magnetic force generation portion includes:

a first ceiling magnetic force generation portion that generates, against the magnet, a repulsion force including a component directed radially inward, and a second ceiling magnetic force generation portion provided at a position separated in a circumferential direction of the rotor further away from the stick region than the first ceiling magnetic force generation portion, and the second ceiling magnetic force generation portion generates, against the magnet, an attraction force including a component directed toward the second ceiling magnetic force generation portion.

6. The rotor according to claim 1, wherein the magnetic force generation portion includes a side wall magnetic force generation portion provided in a side wall that forms a boundary in a circumferential direction of the gap.

7. The rotor according to claim 6, wherein the side wall magnetic force generation portion is configured to generate, against the magnet, a repulsion force including a component directed radially inward and a component directed in a circumferential direction of the rotor away from the stick region.

8. The rotor according to claim 1, wherein the stick region is a region occupied by the damper pin when the damper pin is disposed inside the gap with an outer circumferential surface of the damper pin in contact with one or more wall surfaces that define the gap at, at least, a first point and a second point on the outer circumferential surface of the damper pin that satisfy conditions (a) and (b), where (a) the first point is a point located on a semicircular arc of the outer circumferential surface of the damper pin, being further to the radially outward side of the rotor than a center of the damper pin, and (b) the second point is a point located on a semicircular arc including a reference point that is located furthest to the radially outward side of the rotor on the outer circumferential surface, the semicircular arc being one of two semicircular arcs obtained by dividing the outer circumferential surface in two by a straight line that connects the first point and the center.

9. A rotary machine, comprising:

the rotor according to claim 1.

* * * * *